US007591871B1

(12) United States Patent
Gerung et al.

(10) Patent No.: US 7,591,871 B1
(45) Date of Patent: Sep. 22, 2009

(54) SOLUTION SYNTHESIS OF GERMANIUM NANOCRYSTALS

(75) Inventors: Henry Gerung, Albuquerque, NM (US); Timothy J. Boyle, Kensington, MD (US); Scott D. Bunge, Cuyahoga Falls, OH (US)

(73) Assignee: Sandia Corporation, Albuquerque, NM (US)

( * ) Notice: Subject to any disclaimer, the term of this patent is extended or adjusted under 35 U.S.C. 154(b) by 1071 days.

(21) Appl. No.: 11/060,157

(22) Filed: Feb. 17, 2005

(51) Int. Cl.
*B22F 9/24* (2006.01)

(52) U.S. Cl. ..... 75/362; 75/363; 75/371

(58) Field of Classification Search ..... None
See application file for complete search history.

(56) References Cited

U.S. PATENT DOCUMENTS

| | | | | |
|---|---|---|---|---|
| 5,578,245 | A | 11/1996 | Ziolo | |
| 5,589,234 | A | 12/1996 | Mori et al. | |
| 5,850,064 | A * | 12/1998 | Goldstein | 204/157.4 |
| 6,036,774 | A | 3/2000 | Lieber et al. | |
| 6,262,129 | B1 | 7/2001 | Murray et al. | |
| 6,268,041 | B1 | 7/2001 | Goldstein | |
| 6,455,746 | B1 | 9/2002 | Dubois et al. | |
| 6,645,444 | B2 | 11/2003 | Goldstein | |
| 2003/0003300 | A1 * | 1/2003 | Korgel et al. | 428/402 |
| 2004/0013907 | A1 * | 1/2004 | Waki et al. | 428/694 BA |
| 2005/0029678 | A1 * | 2/2005 | Hanrath et al. | 257/784 |

OTHER PUBLICATIONS

Xianmao Lu, Synthesis of Germanium Nanocrystals in High Temperature Supercritical Fluid Solvents, Nano Letters, 2004, vol. 4, No. 5, 969-974.

Daniele Gerion, Solution Synthesis of Germanium Nanocrystals: Success and Open Challenges, Nano Letters, 2004, vol. 4, No. 4, 597-602.

Enrico Fok, Preparation of alkyl-surface functionalized germanium quantum dots via thermally initiated hydrogermylation, Chem. Commun., 2004, 386-387.

J. P. Wilcoxon, Synthesis and optical properties of colloidal germanium nanocrystals, Physical Review B, 2001 vol. 64, 035417-1 thru 9.

Boyd R. Taylor, Solution Synthesis of Germanium Nanocrystals Demonstrating Quantum Confinement, Chem. Mater., 1998, 10, 22-24.

Scott D. Bunge, Synthesis of Coinage-Metal Nanoparticles from Mesityl Precursors, Nano Letters, 2003, vol. 3, No. 7, 901-905.

* cited by examiner

*Primary Examiner*—George Wyszomierski
(74) *Attorney, Agent, or Firm*—Elmer A. Klavetter

(57) ABSTRACT

A method for providing a route for the synthesis of a Ge(0) nanometer-sized material from. A Ge(II) precursor is dissolved in a ligand heated to a temperature, generally between approximately 100° C. and 400° C., sufficient to thermally reduce the Ge(II) to Ge(0), where the ligand is a compound that can bond to the surface of the germanium nanomaterials to subsequently prevent agglomeration of the nanomaterials. The ligand encapsulates the surface of the Ge(0) material to prevent agglomeration. The resulting solution is cooled for handling, with the cooling characteristics useful in controlling the size and size distribution of the Ge(0) materials. The characteristics of the Ge(II) precursor determine whether the Ge(0) materials that result will be nanocrystals or nanowires.

13 Claims, 3 Drawing Sheets

SOLUTION SYNTHESIS OF GERMANIUM NANOCRYSTALS

This invention was made with Government support under Contract No. DE-AC04-94AL85000 awarded by the Department of Energy. The Government has certain rights in the invention.

BACKGROUND OF THE INVENTION

The present invention relates generally to a method of making germanium nanocrystals and nanowires, and, more particularly, to a method of making germanium nanocrystals and nanowires from germanium (II) precursors.

Nanometer-sized crystalline semiconductor materials have potential applications in optoelectronics, photovoltaics, and biological imaging. These applications are based on the size-dependent quantum confinement effect, which is found in these nanostructure materials. Hence, the ability to control the size of these nanometer-size materials is import in the control of the material electronic and optical properties.

Large-scale solution synthesis routes for compound semiconductor nanocrystals (NCs) such as CdSe, CdS, CdTe, PbSe, ZnO, InP, and AgBr are available. However, suitable solution synthesis routes for Group IV NCs, such as Si and Ge, are not readily available even though Si and Ge are two important semiconductor materials and have been widely used in microelectronics, power generation and display industries.

The discovery of luminescence in porous Si demonstrated the quantum confinement effect in Si and prompted the development of various synthetic routes to Si NCs. Additionally, Si NCs, embedded in a layer of $SiO_2$, were demonstrated to produce stimulated emission and light amplifications upon excitation with a 390 nm laser source. The measured net material gain is comparable to III-V quantum dots. In comparison to Si NCs, Ge NCs have a larger exciton Bohr radius, which translates to a strong quantum confinement effect even at a relatively large NC radius. Even though bulk Ge is an indirect bandgap material, Ge NCs can behave similarly to a direct bandgap material, which can potentially allow the use of Ge NCs as light-emitting or power-generating elements. Simple and convenient synthetic routes, such as solution synthesis, to the production of Ge NCs are therefore desirable.

Ge NCs have been synthesized by several methods, all of which rely on direct reduction of Ge(IV) precursors to Ge(0). Some methods utilize Na/K as a reducing agent, others use a reaction between $Mg_2Ge$ and $GeCl_4$, reduction of $GeCl_4$ or $GeI_4$ using $LiAlH_4$ as a reducing agent, high-pressure reduction, and supercritical fluid methods at high temperature and pressure. These methods encompass the use of reducing agents or salt byproducts in the reaction that makes the separation and purification processes, as well as control over the Ge NC surface, difficult.

Useful would be a solution synthesis process that allows reduction of a Ge precursor to elemental Ge nanocrystals or nanowires from a single precursor without the need for the presence of reducing agents.

DETAILED DESCRIPTION OF THE INVENTION

Figure 1:
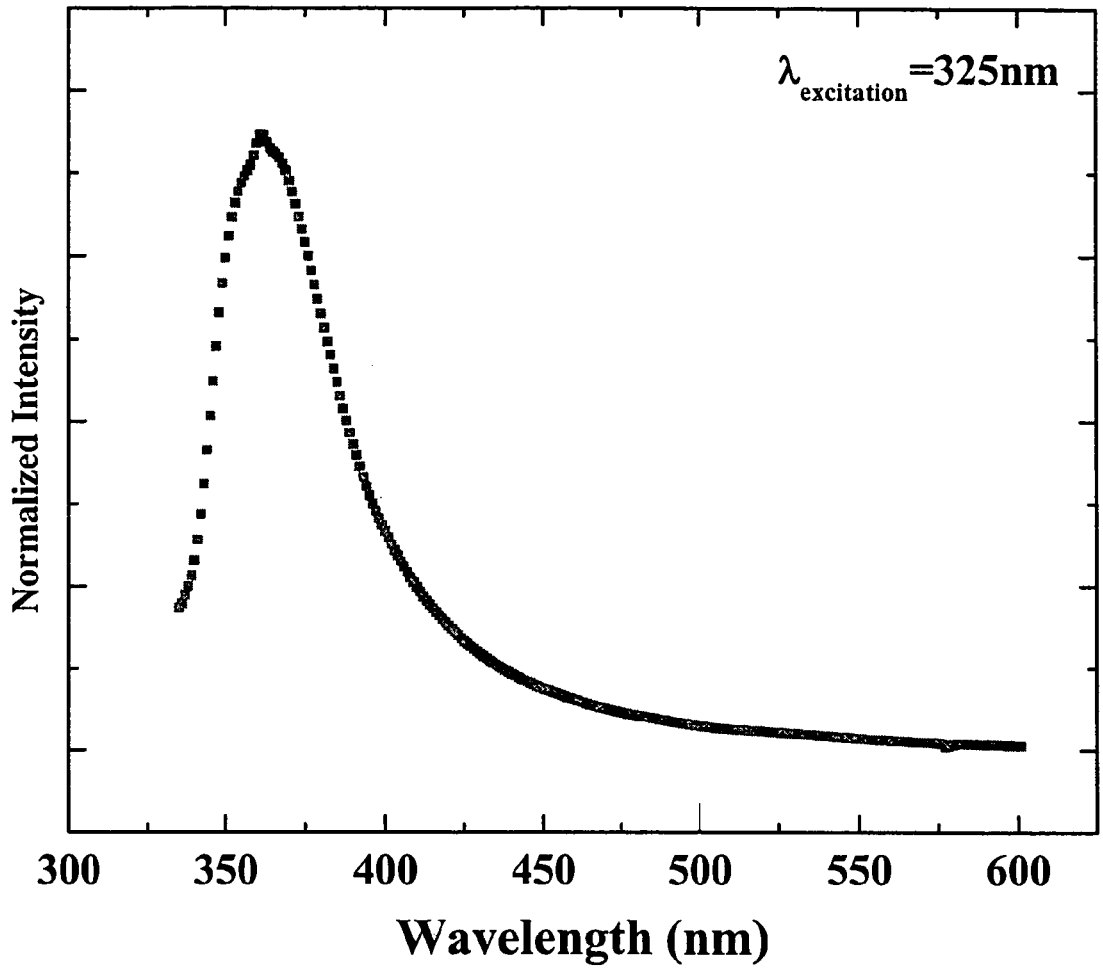
FIG. 1 shows a photoluminescence (PL) spectrum taken at room temperature for nanowires formed according to the method of the present invention.

The present invention relates to a thermal reduction method for synthesizing Ge(0) nanometer-sized materials, comprising either Ge(0) nanocrystals or Ge(0) nanowires. As used herein, "nanocrystals" and "nanowires" define a crystalline domain having dimensions along at least one axis of between 1 nanometer and 100 nanometers and "nanomaterials" refers to nanometer-sized nanocrystals or nanowires or both.

The method involves thermal reduction of a Ge(II) precursor compound to the Ge(0) nanometer-sized material. To form a Ge(0) nanomaterial, a Ge(II) precursor compound is dissolved in a ligand heated to a temperature sufficient to thermally reduce the Ge(II) to Ge(0), where the ligand can be any compound that can bond to the surface of the germanium nanomaterials to subsequently prevent agglomeration of the nanomaterials. This temperature is dependent upon the Ge(II) precursor and ligand compounds used but is generally between approximately 100° C. and 400° C. In an alternate embodiment, the Ge(II) precursor can be mixed with the ligand and a solvent to aid in solubilizing the Ge(II) precursor to form a precursor solution. When heated to an elevated temperature, the Ge(II) is thermally reduced to Ge(0). Alternatively, the Ge(II) precursor dissolved in the ligand can be mixed with a hot solvent where the Ge(II) is thermally reduced to Ge(0). The ligand encapsulates the surface of the Ge(0) material to prevent agglomeration. In any of the embodiments, the resulting solution is cooled for handling, with the cooling characteristics useful in controlling the size and size distribution of the Ge(0) materials. The characteristics of the Ge(II) precursor determine whether the Ge(0) materials that result will be nanocrystals or nanowires.

In general, the Ge(II) precursor can be any compound containing germanium in the +2 oxidation state. The choice of Ge(II) precursor can affect the characteristics of nanomaterials ultimately produced as the precursor will affect whether subsequently formed nanomaterials have facets that can serve as growth sites for formation of nanowires. For example, if the precursor is a Ge(II) amide, the synthesized Ge(0) material can be spherical nanocrystals. If the precursor is a Ge(II) alkoxide, the synthesized Ge(0) material can be nanowires.

The ligand can be any compound that contains a free electron pair that can bond with the germanium nanomaterials. These will generally be compounds containing heteroatoms, such as oxygen, nitrogen, sulfur, and phosphorous. One useful ligand is oleylamine (9-octadecenylamine). The solvent used can be any coordinating or non-coordinating solvent; unsaturated alkyl solvents have been shown to be useful.

The method of the present invention provides a route for the synthesis of Ge(0), nanomaterials, both nanocrystals and nanowires. In one embodiment, all preparations were conducted in an inert atmosphere. In another embodiment, the Ge(II) precursor was the amido-based $Ge(N(SiMe_3)_2)_2$ which can be prepared at room temperature and pressure, where Me refers to a $CH_3$ group. Selecting $Ge(N(SiMe_3)_2)_2$ was based partially on the ease of synthesis, the absence of potential halide contamination, and the labile amido ligand sets. $Ge(N(SiMe_3)_2)_2$ was pre-dissolved in the ligand oleylamine and quickly injected into a hot solution of the non-coordinating solvent octadecene. Upon injection, the Ge(II) precursor was quickly reduced to Ge(0) by the electron pair from oleylamine. The color change from orange yellow to dark brownish-red also indirectly confirms this reduction. As demonstrated by Fourier transform infrared (FTIR) data, oleylamine encapsulated the surface of Ge NCs to prevent agglomeration in an approximately 89% yield. The results have demonstrated the method of the present invention to be a simple, convenient, single-source Ge NC synthesis via thermolysis of Ge(II) precursor $Ge(N(SiMe_3)_2)_2$. This simple reaction is performed at 1 atm without the use of reducing agents and with no salt byproducts.

In an embodiment of the method of the present invention to produce nanocrystals, an orange solution of 1.0 mmol $Ge(N(SiMe_3)_2)_2$ in 12 mmol oleylamine was rapidly injected into a heated solution of 32 mmol octadecene at 300° C., whereupon the mixture turned dark brownish-red. The solution was held at 285° C. for 5 min and then allowed to cool to room temperature. Toluene, or alternatively chloroform or other like solvent, was added, and the solution was extracted twice with methanol. Excess acetone was used to precipitate the Ge NCs. Cooling, including refrigeration, can be used to further induce precipitation. The precipitate was separated by centrifugation (33000 rpm for 25 min) and then re-dispersed in toluene, hexane, or chloroform. The resulting colloid was stable at room temperature under inert conditions. Transmission electron microscopy (TEM) samples were prepared in an Ar-filled glovebox by placing a drop of Ge NCs dispersed in toluene onto a 30-mesh carbon coated copper TEM grid and transported to TEM instrument under an atmosphere of Ar. Infrared (IR) spectra of oleylamine or Ge NCs particles in KBr pellet were obtained with 2 $cm^{-1}$ resolution and 32 scans. Samples for UV-vis and PL (He—Cd laser, CVI DK 480 monochromator, cooled GaAs photomultiplier) were prepared by diluting Ge NCs in toluene, hexane or chloroform solution under Ar.

In another embodiment to produce Ge nanowires, the method uses an alkoxide Ge(II) precursor, such as $Ge(O(2,6\text{-di-tert-butyl phenol}))_2$, referred to as $Ge(DBP)_2$, where DBP=O-2,6-$C_6H_3(CMe_3)_2$. $Ge(DBP)_2$ is synthesized by first preparing the amido-based Ge(II) complex $Ge(N(SiMe_3)_2)_2$, where Me is the $CH_3$ group, discussed in the previous embodiment to produce Ge NCs. The syntheses were conducted using standard inert atmosphere synthetic technique under an inert (argon) atmosphere. Ligand exchange was achieved by addition of 1:2 mole ratio of $Ge(N(SiMe_3)_2)_2$ and di-tert-butyl phenol (DBP-H) in excess toluene, forming an orange solution. The solution was heated briefly at 50° C. and allowed to cool to room temperature. Toluene was evaporated for 1-2 days to drive the formation of $Ge(DBP)_2$ crystals. To synthesize Ge NWs, 0.5 mmol of $Ge(DBP)_2$ was then dissolved in 5 mmol of oleylamine and stirred for 10 minutes. In a different flask, 30 mmol of octadecene was mixed with 2 mmol of oleylamine and heated to 300° C. $Ge(DBP)_2$ solution was then quickly added to the heated solution. The color changed from yellowish to dark purple, indicating formation of Ge(0). Acetone and methanol were used to precipitate the Ge NWs, followed by 10 minutes centrifugation at 33000 rpm. The collected Ge NWs were washed with toluene and methanol to remove other non-reactants or by-products which could then be diluted in toluene.

Based on TEM pictures, NWs are first started by formation of faceted nanocrystals (NCs). NWs grow out epitaxially from the faceted NCs, forming the NWs. It is deduced that, due to excess ligand present in the solution, the NWs start to taper as it extends out further from the growth point. High resolution TEM (HRTEM) showed the NWs d-spacing of 3.26 A growing in (111) direction. No amorphous oxide formed around the Ge NWs. A selected area electron diffraction (SAED) pattern indicated formation of cubic Ge NWs. X-ray diffraction (XRD) experiments were conducted in air atmosphere and confirmed the formation of the cubic structure of Ge NWs formed via this method. However, due to exposure to air, $GeO_2$ was formed. The cubic Ge NWs are stable in air, as shown from an XRD pattern taken approximately 2 months later. A photoluminescence (PL) spectrum taken at room temperature is shown in FIG. 1. The Ge NWs were diluted in toluene under Ar-atmosphere. The sample was then excited at 325 nm using HeCd laser. The emission at the violet region of 360 nm indicates the quantum confinement effect in Ge NWs.

The results show that Ge NWs were successfully formed via solution synthesis without the use of metal catalyst and at a relatively low temperature of 300° C. and atmospheric pressure. From reduction potential considerations, the reduction potential of Ge(II) to Ge(0) is 0.247V and of Ge(IV) to Ge(0) is 0.124V. Hence, Ge(II) reduces to Ge(0) at milder conditions compared to using a Ge(IV) precursor as a starting point.

Figure 2:
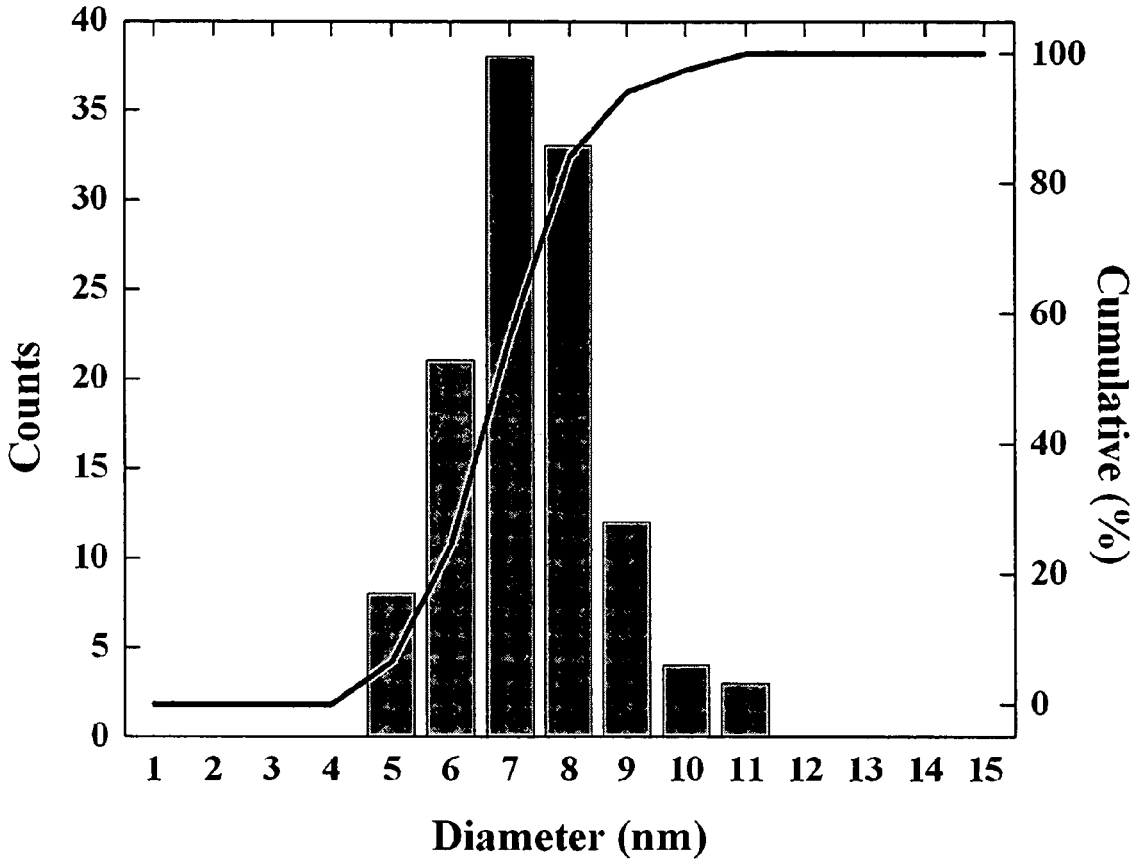
FIG. 2 shows a depiction of the average particle sizes of nanocrystals formed according to the method of the present invention.

Transmission electron microscopy TEM was also used to characterize the shape, size, and crystallinity of the synthesized Ge NCs. The diffraction pattern showed d-spacings of 3.26, 2.00, 1.70, and 1.41 Å, which matches the d-spacings of bulk Ge (111), (220), (311) and (400) cubic phase reflections. The high resolution TEM images showed the cubic lattice structure of the Ge NCs. The Ge NCs characterized by FTIR and TEM characterization did not reveal the presence of $GeO_2$ on the particles. The average particle size, shown in FIG. 2, is 7±4 nm over 119 particles and measured from the longest dimension of the particle. Cumulative data shows that approximately 95% of the particles are less than 8 nm.

As an indirect measure of amine surface passivation, the FTIR spectrum of pure oleylamine was compared with that of Ge NCs, taken with respect to the Ar ambient background. Prior to sampling, the Ge NCs were washed with additional methanol and acetone to remove excess ligand and byproducts. The presence of oleylamine group on Ge NCs is indicated by the N—H wagging mode from 650-900 $cm^{-1}$; $NH_2$ bending modes at 909, 964, and 993 $cm^{-1}$; and $NH_2$ scissor mode at 1568 $cm^{-1}$. The FTIR spectrum also reveals the characteristic peak of C—N stretch at 1042 $cm^{-1}$ which suggests that C—N bonds in amine groups, and therefore oleylamine ligands, remain intact, encapsulating the Ge NCs. The peak at 1468 $cm^{-1}$ is associated with C—H bending mode and the three peaks at 2850, 2922, and 2955 $cm^{-1}$ represent the C—H stretching modes of the oleylamine carbon chain. The large peak at 3500 $cm^{-1}$ has been assigned to the MeOH used in separation step. The presence of various N—H peaks suggests that amines are bound to the surface of the Ge NCs. Upon exposure to air for an extended period of 5 months, no substantial change was observed in the FTIR spectrum. The Ge—O stretch (800-1000 $cm^{-1}$) cannot be resolved from the spectra due to its overlap with N—H wagging mode. However, no appreciable increase in the Ge—O stretching mode at 850 $cm^{-1}$ is observed, even after 5 months of exposure in air. This result suggests that formation of $GeO_2$ is minimal, presumably due to the encapsulation of Ge NC surface by the oleylamine ligands.

Based on the FTIR data, the reaction mechanism was deduced. Upon injection of $Ge(N(SiMe_3)_2)_2$ and oleylamine into hot octadecene solution, the Ge—N bond is cleaved by the oleylamine group and subsequently reduced. The reported Ge—N and Si—N bond strengths are 55 and 78 kcal $mol^{-1}$, respectively, which indicate that Ge—N is more susceptible than Si—N to cleavage. Furthermore, primary amines do not dissociate in the presence of Ge, but upon absorption on Si, primary amines will undergo N—H dissociation, resulting in the formation of Si—H bond with characteristic IR stretching mode at 2066 $cm^{-1}$. The absence of Si—H peak in these spectra indicates that no detectable Si is present on the sample.

Figure 3:
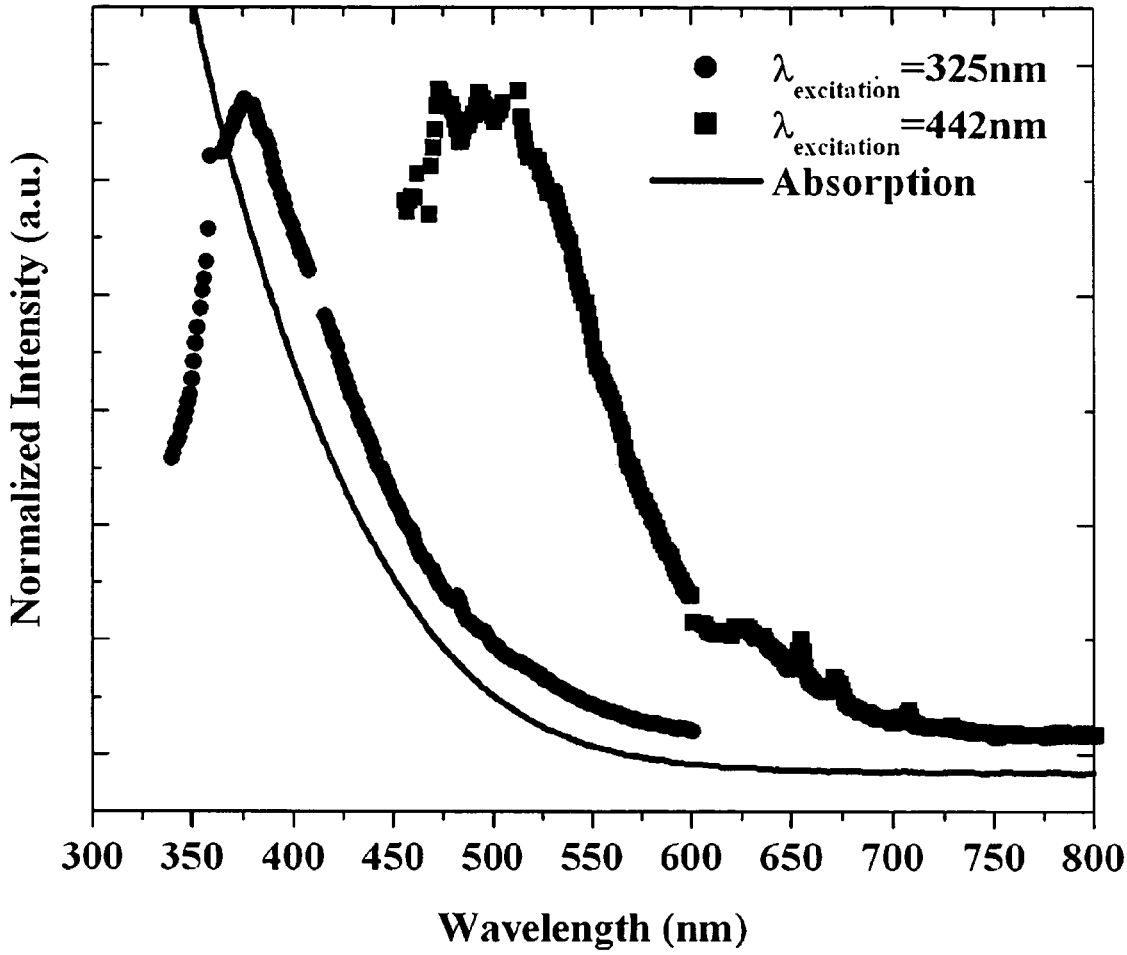
FIG. 3 shows a photoluminescence (PL) spectrum taken at room temperature for nanocrystals formed according to the method of the present invention.

The photoluminescence (PL) of Ge NCs in a toluene solution was conducted at 1 atm of Ar to confirm the quantum confinement effect and shown in FIG. 3. The UV-visible (UV-vis) spectroscopy shows continuous absorption across the spectrum with increasing absorption near UV region. The NCs are excited with 325 and 442 nm HeCd laser lines to excite NCs of different size. The full width half maximum (FWHM) of the excitation from the two laser sources is 2 nm. Since the particles are polydispersed, different emission wavelengths are observed. The emission spectra exhibit strong luminescence at 375 and 500 nm, corresponding to different particle sizes. The corresponding particle sizes based on a theoretical calculation of the emission wavelengths are 5 and 7 nm respectively, in agreement with our observation. Consistent with published results, the size-dependence manifests the quantum confinement effect.

The invention being thus described, it will be apparent to those skilled in the art that the same may be varied in many ways. Such variations are not to be regarded as a departure from the spirit and scope of the invention, and all such modifications are intended to be included within the scope of the following claims.

We claim:

1. A method of making germanium nanomaterials, comprising:

dissolving a Ge(II) precursor compound in a ligand to form a precursor solution, said Ge(II) precursor compound comprising a compound that comprises a germanium atom bonded to an atom selected from a nitrogen atom and an oxygen atom; and heating said precursor solution to thermally reduce the Ge(II) precursor compounds to form Ge(0) nanomaterials in solution.

2. The method of claim 1 wherein said precursor solution comprises an additional solvent.

3. The method of claim 2 wherein said solvent is a coordinating solvent.

4. The method of claim 2 wherein said solvent is a noncoordinating solvent.

5. The method of claim 4 wherein said solvent is octadecene.

6. The method of claim 5 wherein said ligand comprises a heteroatom selected from the group consisting of oxygen, nitrogen, sulfur, phosphorous, and boron.

7. The method of claim 5 wherein said ligand is oleylamine.

8. The method of claim 7 wherein said formed Ge(0) nanomaterials are nanocrystals.

9. The method of claim 1 wherein said ligand has a free electron pair.

10. The method of claim 1 wherein said Ge(II) precursor compound is $Ge(N(Si(CH_3)_3)_2)_2$.

11. The method of claim 1 wherein said Ge(II) precursor compound is $Ge(OC_6H_3(C(CH_3)_3)_2)_2$.

12. The method of claim 1 wherein said formed Ge(0) nanomaterials are nanowires.

13. The method of claim 1 further comprising the step of washing the formed Ge(0) nanomaterials in solution with an organic solvent to form a precipitate of said Ge(0) nanomaterials.

* * * * *